US007351097B2

(12) United States Patent
Hsu

(10) Patent No.: US 7,351,097 B2
(45) Date of Patent: Apr. 1, 2008

(54) ELECTRIC CONNECTOR WITH RIGHT-ANGLED CONTACTS

(75) Inventor: Chun-Hsiung Hsu, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 36 days.

(21) Appl. No.: 11/317,458

(22) Filed: Dec. 22, 2005

(65) Prior Publication Data

US 2006/0141831 A1 Jun. 29, 2006

(30) Foreign Application Priority Data

Dec. 25, 2004 (CN) ..... 2004 2 0054713

(51) Int. Cl.
*H01R 13/66* (2006.01)
*H01R 13/60* (2006.01)

(52) U.S. Cl. ..... 439/541.5; 439/540.1

(58) Field of Classification Search ..... 439/541.5, 439/607, 608, 660, 540.1, 701
See application file for complete search history.

(56) References Cited

U.S. PATENT DOCUMENTS

| | | | | |
|---|---|---|---|---|
| 4,583,807 A | | 4/1986 | Kaufman et al. | |
| 4,867,690 A | * | 9/1989 | Thumma | 439/79 |
| 4,929,196 A | * | 5/1990 | Ponn et al. | 439/620.09 |
| 4,966,556 A | * | 10/1990 | Reymond et al. | 439/80 |
| 5,037,327 A | * | 8/1991 | Van Woensel | 439/571 |
| 5,104,243 A | | 4/1992 | Harding | |
| 5,199,886 A | * | 4/1993 | Patterson | 439/79 |
| 5,213,514 A | * | 5/1993 | Arai | 439/79 |
| 5,453,016 A | * | 9/1995 | Clark et al. | 439/79 |
| 5,593,307 A | | 1/1997 | Bale et al. | |
| 5,934,939 A | | 8/1999 | Thenaisie et al. | |
| 6,099,351 A | * | 8/2000 | Wu | 439/607 |
| 6,155,872 A | * | 12/2000 | Wu | 439/541.5 |
| 6,375,506 B1 | * | 4/2002 | Saunders et al. | 439/607 |
| 6,767,251 B2 | * | 7/2004 | Yu et al. | 439/607 |
| 6,835,074 B2 | * | 12/2004 | Sakata | 439/79 |
| 6,890,221 B2 | * | 5/2005 | Wagner | 439/855 |
| 6,945,820 B1 | * | 9/2005 | Blichasz et al. | 439/620.05 |
| 2002/0137400 A1 | * | 9/2002 | Billman et al. | 439/701 |
| 2004/0014360 A1 | * | 1/2004 | Crane et al. | 439/608 |

* cited by examiner

*Primary Examiner*—Chandrika Prasad
(74) *Attorney, Agent, or Firm*—Wei Te Chung

(57) ABSTRACT

A right-angled backplane connector (100) includes an insulative housing (20), a number of contacts (40) received in the housing (20), and a spacer (60) assembled to the housing. The housing (20) forms a front mating portion (22) adapted to mating with a mating connector and a rear mounting portion (24) integrally connected to the mating portion (22). The mounting portion (24) defines a bottom wall (244) adapted to be mounted on a printed circuit board. A number of mounting posts (248) protrudes from the bottom wall (244) to engage in a corresponding number of mounting holes defined in the printed circuit board. The mounting portion (24) further defines inserting slots (240) for a part of a fixture to be inserted therein to support the contacts when the contacts (40) are inserted into the housing (20) by the fixture.

10 Claims, 5 Drawing Sheets

ELECTRIC CONNECTOR WITH RIGHT-ANGLED CONTACTS

BACKGROUND OF THE INVENTION

1. Field of the Invention

The present invention relates to a backplane connector, and more particularly, to a right-angled backplane connector to be mounting on a printed circuit board.

2. Description of the Prior Art

A conventional right-angled backplane connector, disclosed in U.S. Pat. No. 4,583,807 issued to Kaufman et al. on Oct. 10, 1995, includes an insulative housing and a plurality of conductive contacts arranged in rows in the housing. The housing includes a U-shaped mating portion for engaging a mating connector and a mounting portion for being mounted on a printed circuit board. The mating portion forms a rear wall and a pair of lateral walls perpendicularly extending from two opposite end of the rear wall to define a slot for receiving the mating connector. The mounting portion extends backwardly from the rear wall for being mounted on the printed circuit board. A pair of metal posts are insert-molded into the mounting portion of the housing and laterally protrude for firmly positioning the connector to the printed circuit board. The contacts forms a contact portion in the slot and a securing portion engaging the mounting portion and a tail for making electrical connection to the printed circuit board. The securing portion of each contact has a great length mating with the mounting portion, which increases the difficulty to assemble the contacts to the housing. Further more, the tails of the contacts are disposed out side of the housing without any constraint and so tend to offset the right position, which will negatively affect the electrical connection between the tail and the substrate. Another similar conventional backplane connector, disclosed in U.S. Pat. No. 5,104,243 issued to Harding on Apr. 14, 1992, has the same defects as described above.

Still another conventional backplane connector is disclosed in either U.S. Pat. No. 5,593,307 issued to Bale et al. on Jan. 14, 2002 or U.S. Pat. No. 5,934,939 issued to Thenaisie et al. on Aug. 10, 1999. The backplane connector is similar to the ones described above except that the mounting portion is separative from the mating portion. The engagement between the mating portion and the mounting portion makes the mating portion is comparatively looser from the mounting portion, so that the mating force acting on the contacts is delivered directly to the connection between the tails of the contacts and the printed circuit board when the mating connector is inserted into the slot of the mating portion, which negatively affects the electrical connection thereof.

Hence, an improved right-angled backplane connector is needed to solve the above problems.

BRIEF SUMMARY OF THE INVENTION

The present invention provides a right-angled backplane connector including an insulative housing and a plurality of conductive contacts received in the housing. The housing includes a front mating portion and a rear mounting portion adapted to be installed on a printed circuit board. The mounting portion extends backwardly from the mating portion. Each of the conductive contacts includes a securing portion engaging the mating portion, a contact portion forwardly from the securing portion, a supporting portion extending backwardly from the securing portion through the mounting portion, and a tail connected to the supporting portion in a right angle adapted to electrically connect the printed circuit board. The mounting portion defines a plurality of inserting slots parallel to the extending direction of the supporting portion.

In a preferred embodiment, the connector further includes a spacer connected to the mounting portion of the housing. The spacer forms a number of separating walls to define another number of slots for positioning the tails of the contacts. Each of the separating walls defines a slot facing the printed circuit board, while corresponding contacts forms a pair of blocks extending sideward from an up end of the tail. The blocks engage in the slots, which keeps the tails in position and help to the tails to form steady electrical connections with the printed circuit board.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
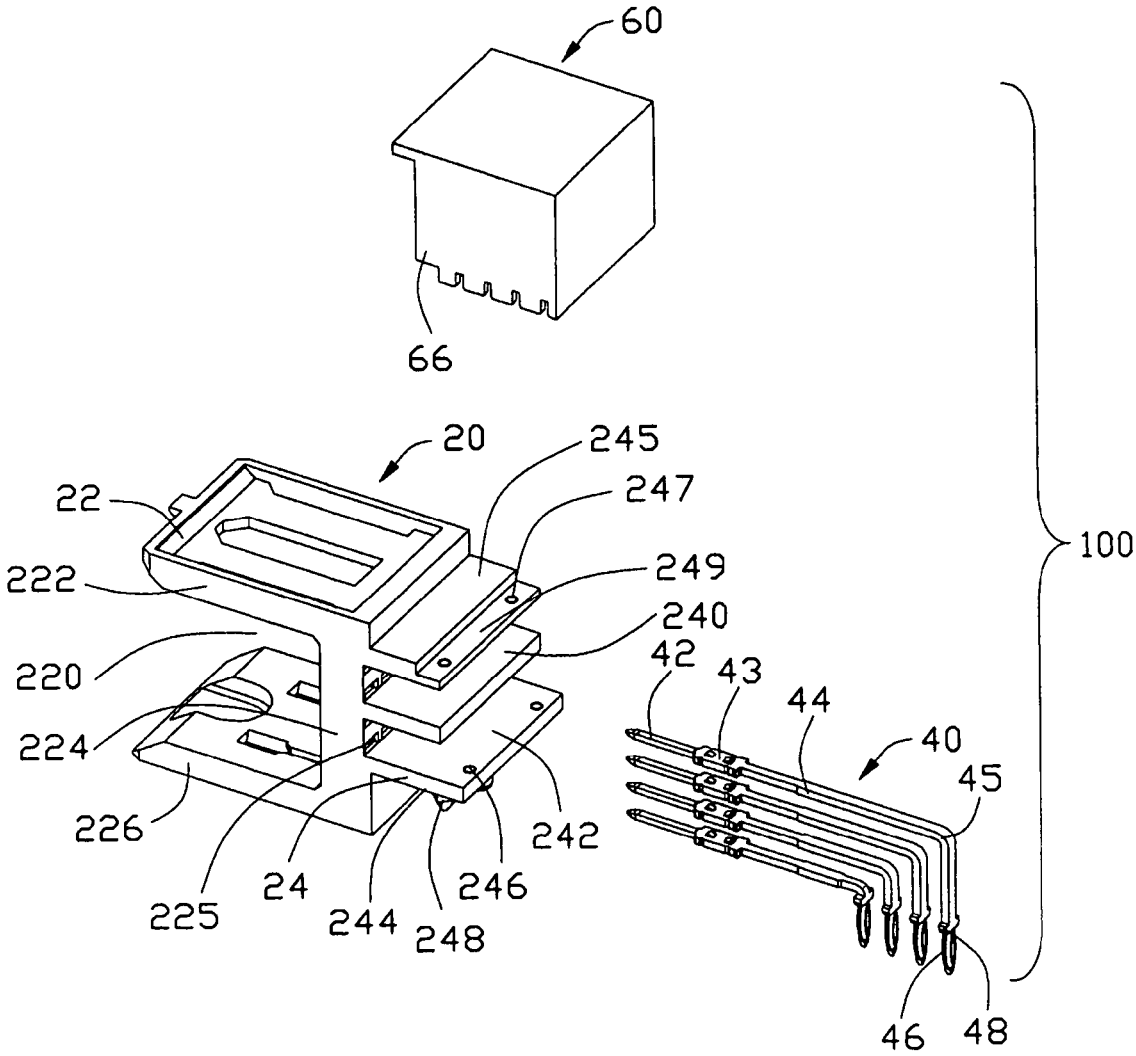
FIG. 1 is an exploded view of a backplane connector of the present invention, with only one set of contacts shown for clear showing.

Reference will now be made to the drawing figures to describe the present invention in detail.

FIG. 1 shows a right-angled backplane connector 100 according to present invention. The connector 100 includes an insulative housing 20, a plurality of conductive contacts 40 received in the housing 20, and a spacer 60 assembled to the housing 20.

The housing 20 forms a mating portion 22 for engaging with a mating connector (not shown) and a mounting portion 24 integrally connected to the mating portion 22. The mating portion 22 forms a rear wall extending uprightly and a pair of lateral walls 222,226 extending forwardly from opposite ends of the rear wall 224 to define a U-shaped slot 220 facing forwardly. The rear wall 224 defines rows of contact holes 225 cutting through the rear wall 224 perpendicularly. The mounting portion 24 extends backwardly from the rear wall 224 and forms a plurality of partition walls (not labelled). Said partition walls define a pair of inserting slots 240 parallel to the lateral wails 222,226. The inserting slots 240 cut through the housing 20 horizontally and communicate two rows of contact holes 225. The partition walls include a bottom wall 244 and a top wall 245 parallel to the lateral sidewalls 222,226. The bottom wall 244 is adapted to be mounted on a printed circuit board and three mounting posts 248 protrude there from. The mounting posts are used to engage in three through holes defined in the printed circuit board for firmly securing the connector 100 to the printed circuit board. Backward along the bottom wall 244, the mounting portion 24 extends a fastening board 242 in which two fastening holes 246 are defined. The top wall 245 forms a step 249 at the end and the step 249 defines a pair of fastening holes 247 therein communicating the inserting slot 240.

Each of the contacts 40 includes a securing portion 43 for engaging in corresponding contact hole 225, a contact portion 42 extending forwardly from the securing portion 43 for contacting corresponding contact arranged in the mating connector, a supporting portion 44 extending backwardly from the securing portion 43, a tail 46 perpendicular to the supporting portion 44 for electrically connecting the printed circuit board, and an elbow portion 45 bent in a right angle connecting the tail 46 to the supporting portion 44. Furthermore, the contact 44 has a pair of block 48 oppositely formed at a top end of the tail 46.

Figure 2:
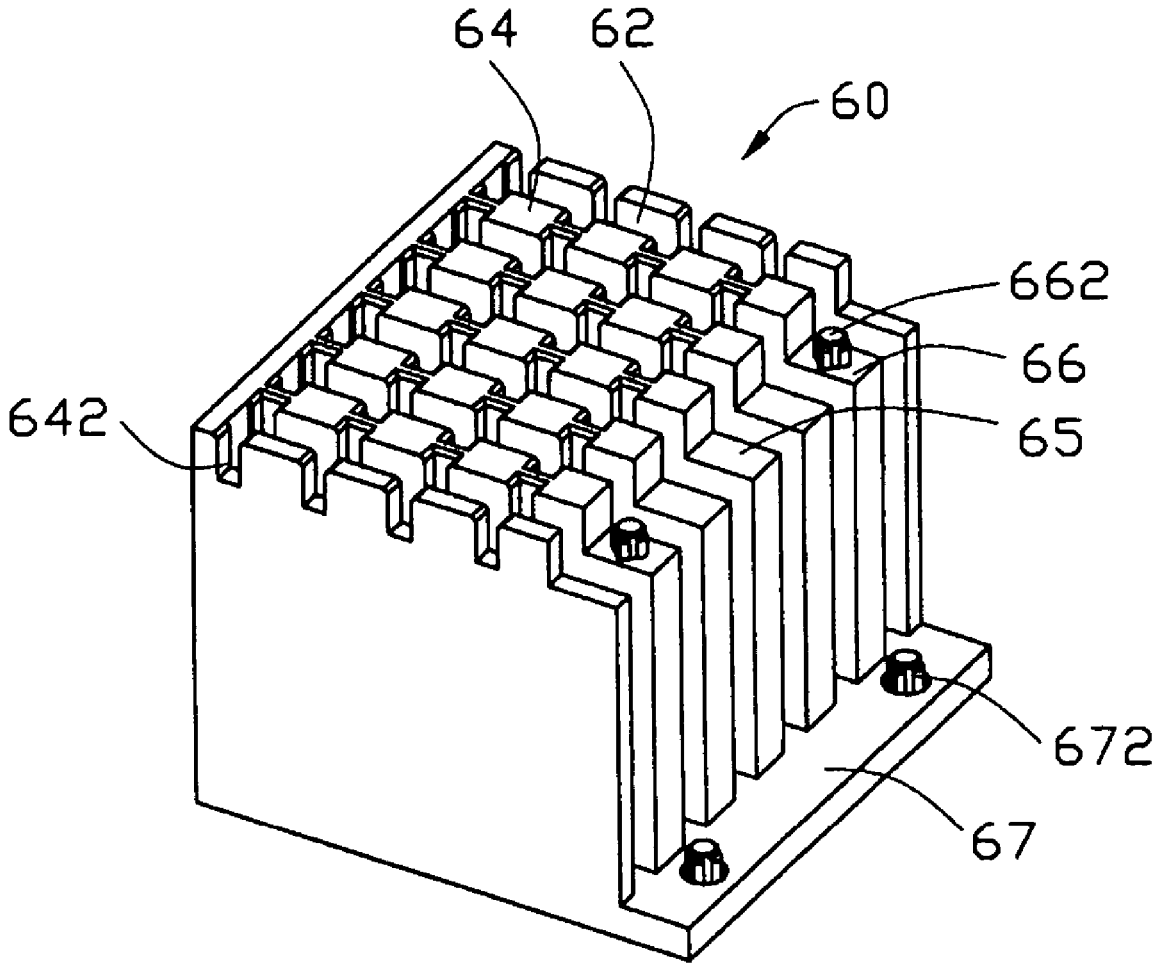
FIG. 2 is a perspective view of a spacer of the backplane connector shown in FIG. 1.

Referring to FIG. 2, the spacer 60 forms a number of separating walls 64 to define a corresponding number of receiving slots 62 to accommodate the elbow portion 45 of the contacts 40. The separating walls 64 extend to abut the printed circuit board and define a plurality of pressing slots 642 open to the printed circuit board. Corresponding to the step 249 of the housing 20, the spacer 66 protrudes a fastening tab 67 and the fastening tab 67 protrudes a pair of fastening posts 672 corresponding to the fastening holes 247. The spacer 60 further forms a step 65 to abut the fastening board 242 so that a plurality of shoulders 66 is formed. Two of the shoulders 66 protrude a pair of fastening posts 662 corresponding to the fastening holes 246.

Figure 3:
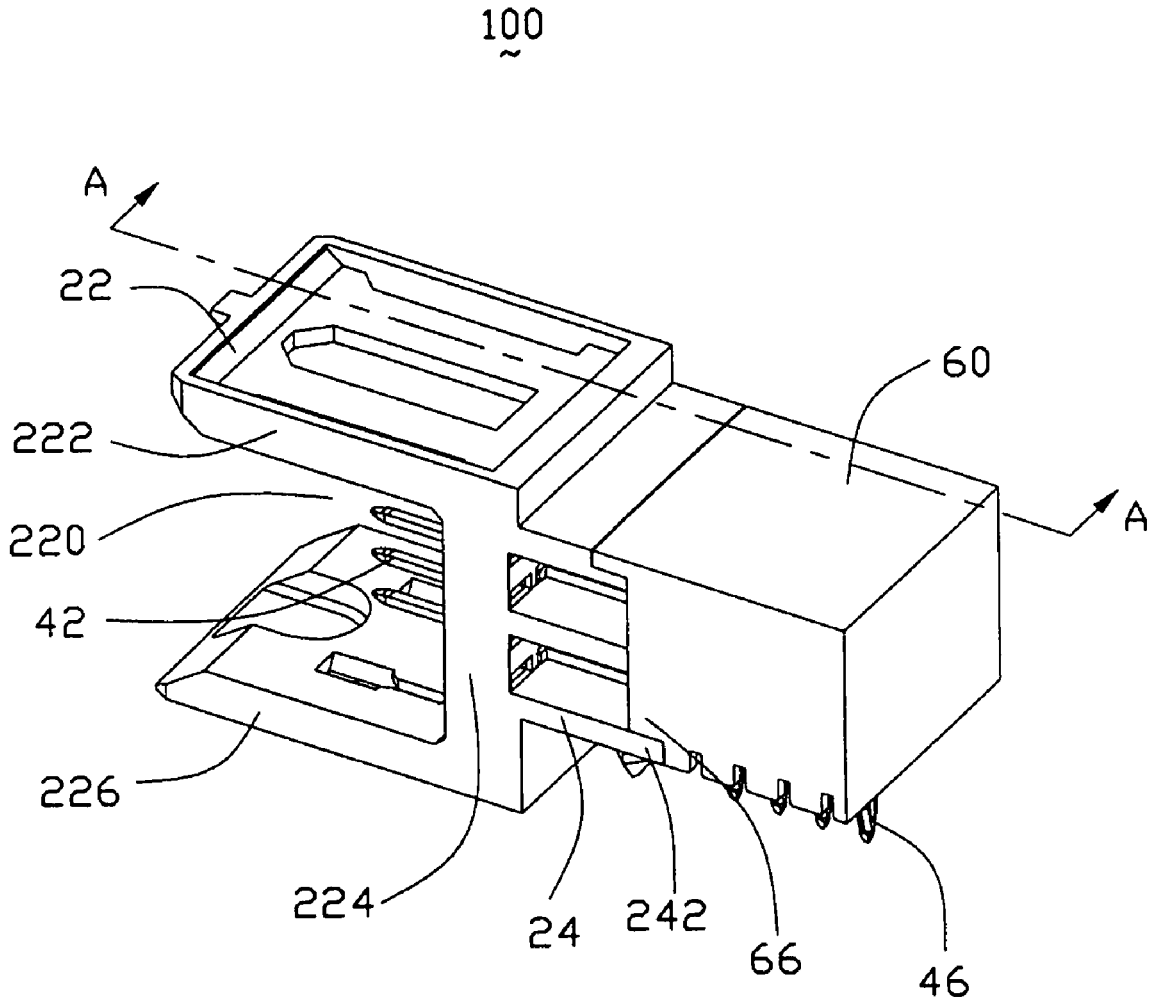
FIG. 3 is a perspective assembled view of the backplane connector shown in FIG. 1.
Figure 4:
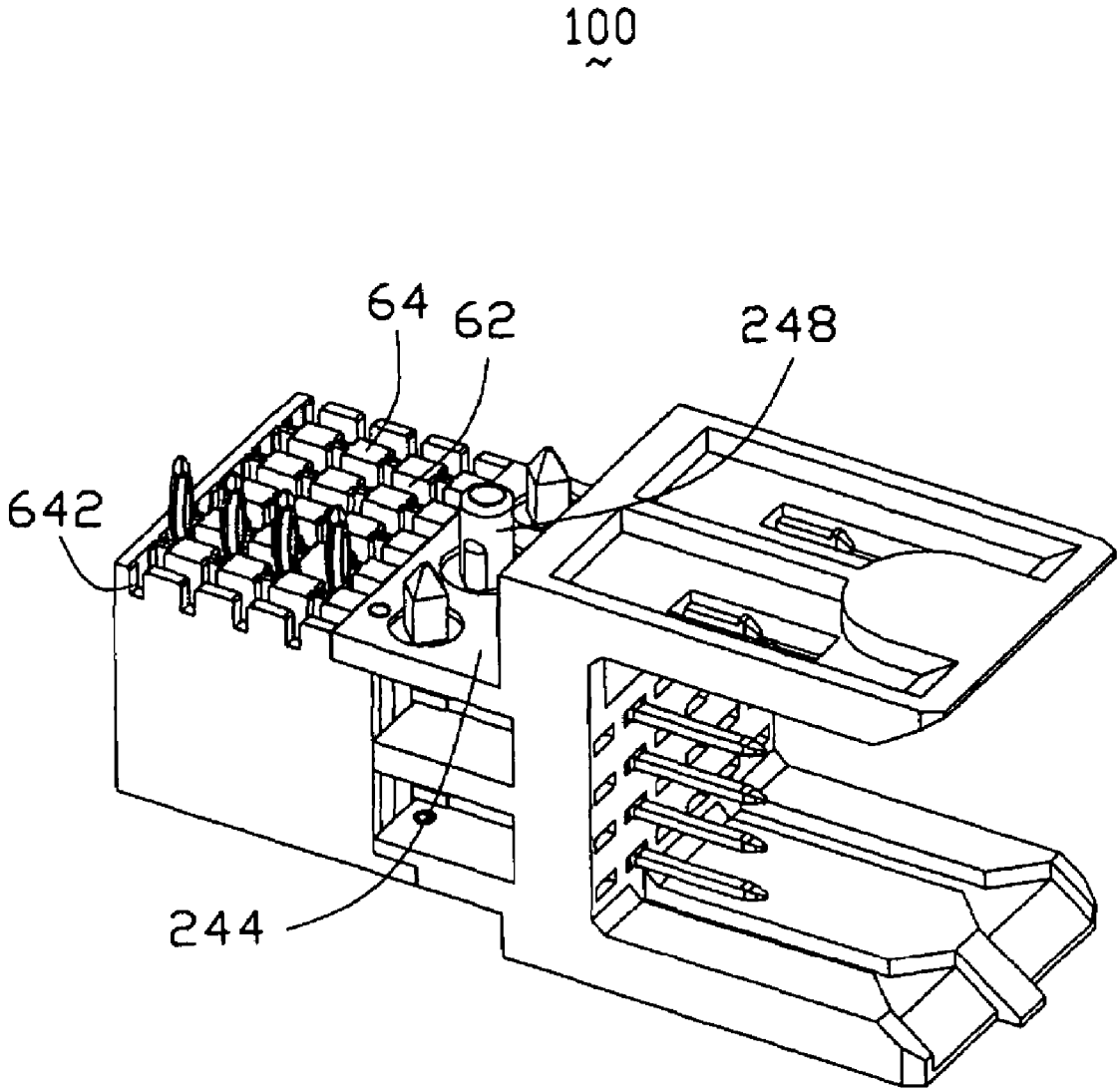
FIG. 4 is another perspective view of the backplane connector of FIG. 3.
Figure 5:
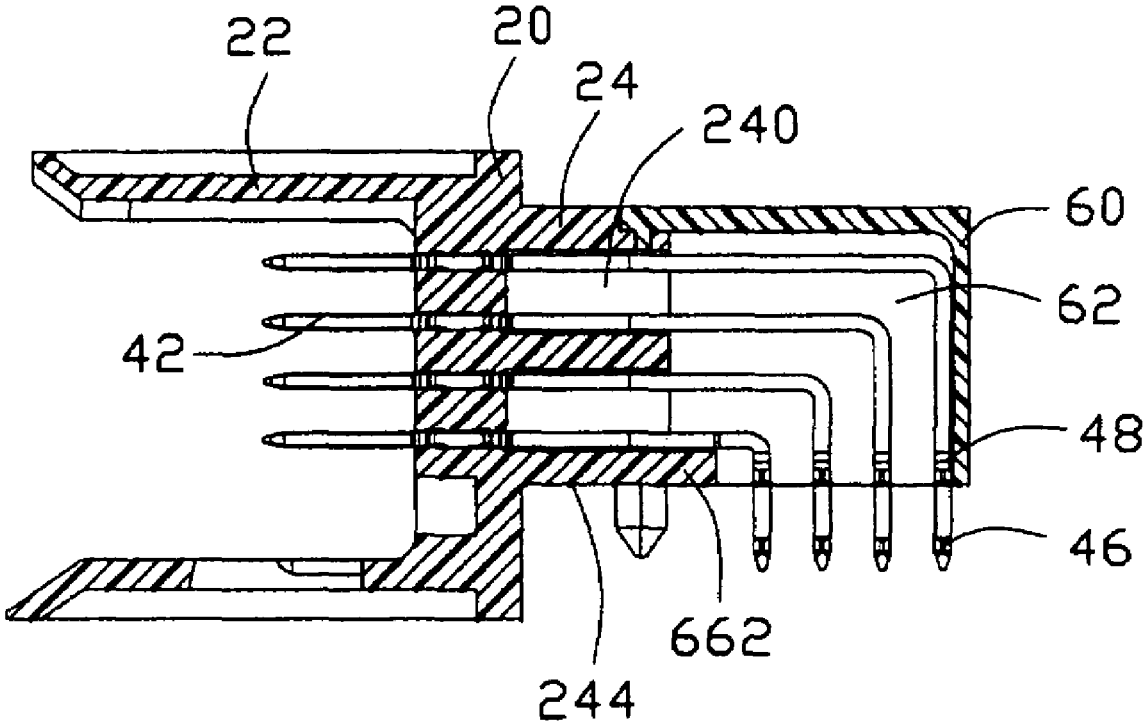
FIG. 5 is a sectional view of the modular jack taken along line 5-5 in FIG. 3.

Referring to FIGS. 3, 4, 5, to assemble the connector 100, the housing 20, a plurality of contacts 40 and the spacer 60 is respectively provided. Firstly, the contacts 40 are inserted partly into the contact holes 225 to a first position where the contacts 40 are loosely positioned. Secondly, the contacts 40 are pressed into the housing 20 to a final position where the securing portions 43 of the contacts 40 are firmly secured by the rear wall 224 of the housing 20. When the contacts 40 are being pressed to the final position by a tool, a part of the tool is inserted into the inserting slots 240 to support the supporting portion 44 in case that the supporting portion 44 become crooked. Finally, the spacer 60 is assembled to the housing 20 with the fastening posts 662,672 fitting into the fastening holes 246,247. Then, the elbow portions 45 of the contacts 44 are received in corresponding receiving slots 62 and the blocks 48 are received in the pressing slots 640 to position the tails 46 of the contacts 40 for facilitating later insertion of the tails 46 into the holes defined in the printed circuit board.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

I claim:

1. An electrical connector mounted on a printed circuit board (PCB) comprising:

an insulative housing having a front mating portion and a rear mounting portion extending backwardly from the front mating portion, said front mating portion defining a plurality of contact holes arrayed in rows and columns; and a plurality of conductive contacts arrayed in the contact holes of the housing;

wherein said rear mounting portion forms a plurality of partition walls extending parallel to the printed circuit board and defining therebetween a plurality of inserting slots, said inserting slots cutting through said rear mounting portion and each of said inserting slots communicating two rows of the contact holes so that enough space is provided for receiving a part of a tool when said contacts are being inserted into the housing by the tool.

2. The electrical connector according to claim 1, wherein each of said contacts comprises a securing portion retained within the mating portion, a mating portion extending forwardly from the securing portion, an elbow portion extending backwardly from the securing portion, and a tail portion perpendicularly projecting from said elbow portion and electrically connecting said printed circuit board.

3. The electrical connector according to claim 1, wherein said partition walls include a bottom wall to be mounted on the printed circuit board, said bottom wall having a plurality of mounting posts downwardly protruding therefrom.

4. The electrical connector according to claim 1, wherein said mating portion forms a rear vertical wall and a pair of lateral horizontal walls to define a space therebetween.

5. The electrical connector according to claim 1, further comprising a spacer fastened to said rear mounting portion of the housing, wherein said spacer forms a plurality of separating walls to define a plurality of receiving slots for receiving and positioning said contacts.

6. The electrical connector according to claim 5, wherein each of said contacts comprises a securing portion retained within the mating portion, a mating portion extending forwardly from the securing portion, an elbow portion extending backwardly from the securing portion, and a tail portion perpendicularly projecting from said elbow portion and electrically connecting said printed circuit board.

7. The electrical connector according to claim 6, wherein said separating walls define a plurality of pressing slots facing the printed circuit board, each of said contacts forming a pair of blocks at a top end of said tail of the contact, said pair of blocks engaging in corresponding pressing slots.

8. The electrical connector according to claim 5, wherein said spacer forms a plurality of fastening posts and said mounting portion of the housing defines a corresponding number of fastening holes, said fastening posts engaging in said fastening holes to fasten said spacer to said housing.

9. An electrical connector comprising:

an insulative housing defining a plurality of passageways in matrix;

a plurality of contacts disposed in the corresponding passageways, respectively, each of said contacts including a front mating section, a rear horizontal supporting section and a tail section extending downwardly from the supporting section;

a plurality of horizontal partition walls integrally extending rearwardly from a rear face of the housing; and an insertion slot formed between every adjacent two partition walls and communicating with two corresponding passageways in a front-to-back direction; wherein for each insertion slot with the two adjacent corresponding partition walls respectively located at a top and at a bottom of said insertion slot, the supporting section of the contact located in one of said two corresponding passageways, abuts against an underside of the partition wall which is position at the top of the insertion slot, and the supporting section of the contact located in the other of said two corresponding passageways, abuts against an upper face of the partition wall which is located at a bottom of the insertion slot.

10. An electrical connector comprising:

an insulative housing defining a plurality of passageways in matrix;

a plurality of contacts disposed in the corresponding passageways, respectively, each of said contacts including a front mating section, a rear horizontal supporting section and a tail section extending from the supporting section;

a plurality of partition walls integrally extending rearwardly from a rear face of the housing; and an insertion slot formed between every adjacent two partition walls and communicating with two corresponding passageways in a front-to-back direction; wherein for each insertion slot with the two adjacent corresponding partition walls respectively located at two opposite sides of said insertion slot, the supporting section of the contact located in one of said two corresponding passageways, abuts against a face of the partition wall which is position at one of said two opposite sides of the insertion slot, and the supporting section of the contact located in the other of said two corresponding passageways, abuts against a face of the partition wall which is positioned at the other side of the insertion slot.

* * * * *